US009255359B2

(12) United States Patent
Altinier et al.

(10) Patent No.: US 9,255,359 B2
(45) Date of Patent: Feb. 9, 2016

(54) ROTATABLE-DRUM LAUNDRY DRIER AND METHOD OF CONTROLLING A ROTATABLE-DRUM LAUNDRY DRIER

(75) Inventors: Fabio Altinier, Codognè (IT); Michele Bisaro, Spilimbergo (IT); Roberto Ragogna, Malnisio (IT)

(73) Assignee: Electrolux Home Products Corporation N.V., Brussels (BE)

( * ) Notice: Subject to any disclaimer, the term of this patent is extended or adjusted under 35 U.S.C. 154(b) by 275 days.

(21) Appl. No.: 13/990,147

(22) PCT Filed: Nov. 28, 2011

(86) PCT No.: PCT/EP2011/071104

§ 371 (c)(1),
(2), (4) Date: Oct. 14, 2013

(87) PCT Pub. No.: WO2012/072530

PCT Pub. Date: Jun. 7, 2012

(65) Prior Publication Data

US 2014/0026435 A1 Jan. 30, 2014

(30) Foreign Application Priority Data

Nov. 29, 2010 (EP) ..... 10192928

(51) Int. Cl.
*D06F 58/20* (2006.01)
*D06F 58/28* (2006.01)

(52) U.S. Cl.
CPC ..... *D06F 58/28* (2013.01); *D06F 2058/2819* (2013.01); *D06F 2058/2825* (2013.01); *D06F 2058/2838* (2013.01)

(58) Field of Classification Search
CPC ..... D06F 58/00; D06F 58/20; D06F 58/06; F26B 21/00; F26B 21/06; G01M 1/00; G01M 1/16; G01R 21/00
USPC ..... 34/595, 601, 575, 522, 381, 411, 413; 68/5 C, 5 R, 19, 20, 12.06; 8/132, 149; 73/460, 65.07, 65.01; 702/60
See application file for complete search history.

(56) References Cited

U.S. PATENT DOCUMENTS 4,397,101 A * 8/1983 Rickard ..... 34/486
4,586,267 A * 5/1986 Sussman ..... 34/490

(Continued)

FOREIGN PATENT DOCUMENTS

DE 102008025496 A1 * 12/2009 ..... D06F 58/28
EP 1457594 A2 9/2004

(Continued)

OTHER PUBLICATIONS

International Search Report mailed Sep. 3, 2012 in corresponding International Application No. PCT/EP2011/071104.

(Continued)

*Primary Examiner* — Stephen M Gravini
(74) *Attorney, Agent, or Firm* — Banner & Witcoff, Ltd.

(57) ABSTRACT

A method for controlling a rotatable-drum laundry drier to dry laundry in a drum is provided. The control method includes the steps of memorizing, in a memory device of the laundry drier, a comparison threshold variable in time according to a predetermined profile, and, at predetermined drying times in the laundry drying cycle, measuring an electric quantity indicating the moisture in the laundry at the drying time; comparing, at each drying time, the measured electric quantity with the memorized comparison threshold corresponding to the drying time; and determining the end of drying cycle time on the basis of this comparison.

20 Claims, 4 Drawing Sheets

(56) References Cited

U.S. PATENT DOCUMENTS

| | | | | |
|---|---|---|---|---|
| 5,682,684 | A * | 11/1997 | Wentzlaff et al. | 34/495 |
| 6,931,760 | B2 * | 8/2005 | Yang | 34/491 |
| 7,013,578 | B2 * | 3/2006 | Wunderlin et al. | 34/528 |
| 7,322,126 | B2 * | 1/2008 | Beaulac | 34/554 |
| 8,112,902 | B2 * | 2/2012 | Muenzner et al. | 34/381 |
| 2002/0184789 | A1 * | 12/2002 | Gardner et al. | 34/491 |
| 2004/0200093 | A1 | 10/2004 | Wunderlin et al. | |
| 2005/0091876 | A1 | 5/2005 | Yang | |
| 2006/0242858 | A1 | 11/2006 | Beaulac | |
| 2012/0022830 | A1 * | 1/2012 | Prajescu et al. | 702/176 |
| 2013/0326904 | A1 * | 12/2013 | Altinier et al. | 34/499 |
| 2014/0026435 | A1 * | 1/2014 | Altinier et al. | 34/427 |
| 2014/0115916 | A1 * | 5/2014 | Altinier et al. | 34/282 |

FOREIGN PATENT DOCUMENTS

| | | | |
|---|---|---|---|
| EP | 2537975 | A1 * | 12/2012 |
| MX | 2010/008115 | * | 7/2010 |
| WO | 02090855 | A1 | 11/2002 |
| WO | 2006046835 | A1 | 5/2006 |

OTHER PUBLICATIONS

European Search Report dated Jul. 12, 2011 in corresponding EP Application No. 10192928.9.

* cited by examiner

ROTATABLE-DRUM LAUNDRY DRIER AND METHOD OF CONTROLLING A ROTATABLE-DRUM LAUNDRY DRIER

BACKGROUND

Embodiments of the present invention relate to a rotatable-drum laundry drier, and to a method of controlling a rotatable-drum laundry drier.

The present invention relates to a rotatable-drum laundry drier, and to a method of controlling a rotatable-drum laundry drier.

Methods of controlling rotatable-drum laundry driers are known, in which: hot air is fed into the rotating drum so as to flow over the laundry inside; the impedance of the laundry is measured by measuring electrodes positioned contacting the laundry; the moisture of the laundry is determined on the basis of the impedance measurement; and the drying cycle is stopped when the impedance measurement reaches a substantially time-constant comparison threshold associated with a predetermined final moisture.

Tests conducted by the Applicant show that the actual moisture of the laundry at the end of the drying cycle using the above methods differs from the predetermined final moisture, depending on the quantity/weight of the laundry in the drum, and the difference is particularly marked when drying certain types of laundry, such as cotton, and/or synthetic fabrics.

FIG. 1 shows an example graph of the moisture of different quantities/weights of cotton laundry, as determined by the Applicant on the basis of laboratory drying test measurement data on a prior art laundry drier. As can be seen, using the control methods described above (in which the impedance of the laundry is compared with a time-constant comparison threshold), loads ranging between roughly 1 kg and 8 kg show a laundry moisture percentage ranging between roughly 24% and 11% of the laundry weight respectively. In other words, a 7 kg difference in load produces a 13% difference in final moisture, which is obviously unacceptable.

To achieve a precise, stable final moisture, regardless of the quantity/weight of the laundry, an electronic control system has been proposed, configured to determine the quantity/weight of the laundry in the drum using weight sensors, and to adjust the comparison threshold accordingly. This solution, however, is expensive and complicated to produce.

The Applicant has therefore researched thoroughly into devising a straightforward, low-cost solution designed to achieve a precise, stable final moisture, regardless of the quantity/weight of the laundry in the drum.

It is therefore an object of the present invention to provide a solution designed to achieve the above goals.

SUMMARY OF SELECTED INVENTIVE ASPECTS

According to embodiments of the present invention, there is provided a control method for controlling a rotatable-drum laundry drier to dry laundry in a drum, comprising the steps of:

- memorizing in a memory device of the laundry drier a comparison threshold variable in time according to a predetermined profile, and
- at predetermined drying times in the laundry drying cycle:
  - measuring an electric quantity indicating the moisture in the laundry at the drying time;
  - comparing, at each drying time, the measured electric quantity with the memorized comparison threshold corresponding to the drying time;

- determining the end of drying cycle time on the basis of said comparison.

Advantageously, the end of drying cycle time corresponds to the drying time at which the measured electric quantity reaches the comparison threshold.

In some embodiments, the comparison threshold is variable in time according to a predetermined discrete profile.

In some embodiments, the predetermined discrete profile comprises a number of different threshold values, each corresponding to a predetermined drying time interval and to a predetermined laundry quantity/weight.

In a further advantageous embodiment, the comparison threshold is variable in time according to a predetermined continuous profile.

In some embodiments, the electric quantity is the resistance/conductance/impedance measured between at least two measuring electrodes positioned in such a way to contact the laundry in the drum.

Opportunely, the method comprises the steps of:

- calculating the laundry quantity/weight on the basis of the comparison threshold corresponding to the end of drying cycle time, and
- adjusting the duration of a laundry cooling stage, subsequent to the end of drying cycle time, on the basis of the calculated laundry quantity/weight.

In a further aspect, the present invention relates to a rotatable-drum laundry drier comprising:

- a memory device in which a comparison threshold, variable in time according to a predetermined profile, is memorized;
- an electronic control unit configured to:
  - measure an electric quantity indicating the moisture in the laundry at a drying time;
  - comparing the measured electric quantity with the comparison threshold corresponding to this drying time; and
  - determine the end of drying cycle time on the basis of the comparison.

In some embodiments, in the laundry drier according to the invention the end of drying cycle time corresponds to the drying time at which the measured electric quantity reaches the comparison threshold.

In some embodiments, in the laundry drier according to the invention the comparison threshold is variable in time according to a predetermined discrete profile.

In some embodiments, the predetermined discrete profile comprises a number of different threshold values, each corresponding to a predetermined drying time interval and to a laundry quantity/weight.

In a further embodiment of the laundry drier according to the invention, the comparison threshold is variable in time according to a predetermined continuous profile.

In some embodiments, in the laundry drier according to the invention the electric quantity is the resistance/conductance/impedance measured between two electrodes contacting the laundry.

Advantageously, in the laundry drier according to the invention the control unit is configured to calculate the laundry quantity/weight on the basis of the comparison threshold corresponding to the end of drying cycle time, and to adjust the duration of a laundry cooling stage, subsequent to the end of drying cycle time, on the basis of the calculated laundry quantity/weight.

In a further aspect thereof, the invention is related to an electronic control unit for controlling a rotatable-drum laundry drier configured to implement a control method according to the invention.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 2:
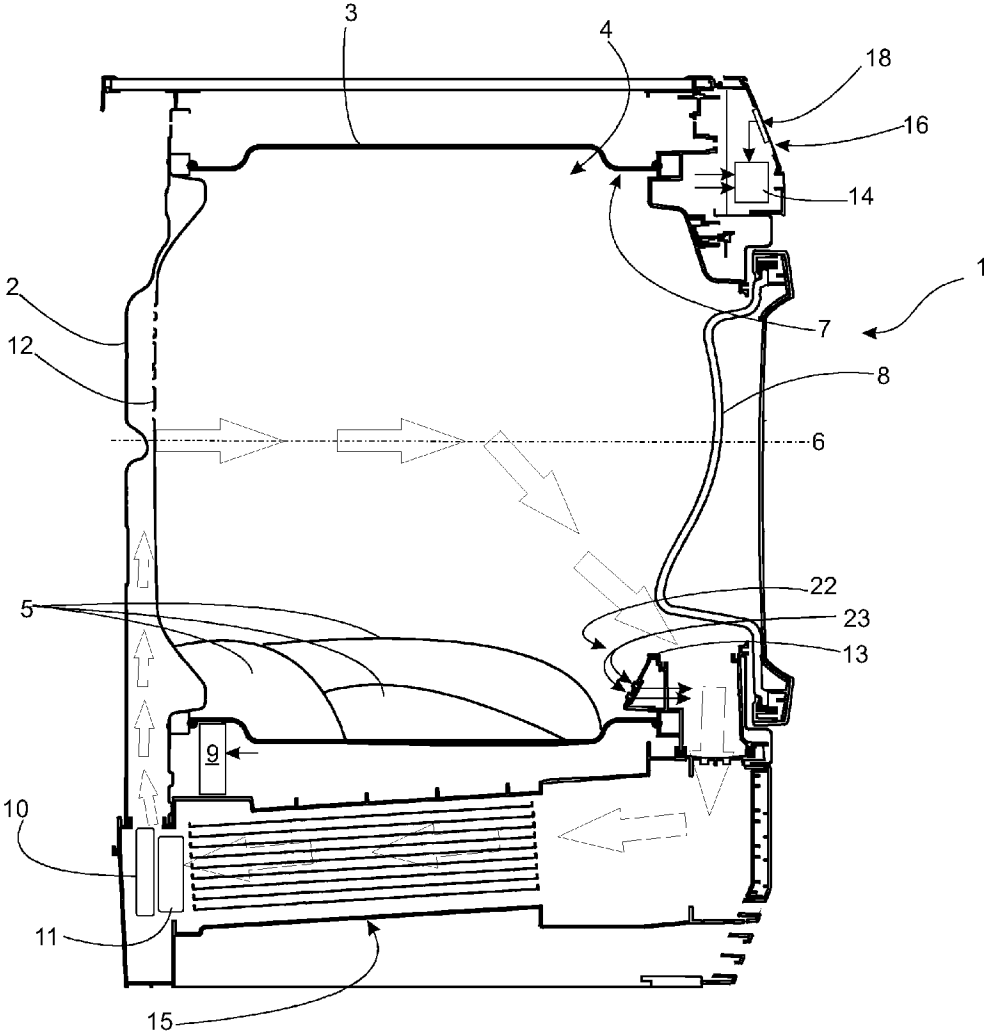
FIG. 2 shows a schematic lateral cross section of a rotatable-drum laundry drier implementing the laundry drying control method according to an embodiment of the present invention.

Number 1 in FIG. 2 indicates as a whole a rotatable-drum laundry drier comprising an outer casing 2 that preferably rests on the floor on a number of feet. Casing 2 supports a rotatable laundry drum 3, which defines a drying chamber 4 for laundry 5 and rotates about a preferably, though not necessarily, horizontal axis of rotation 6. In an alternative embodiment not shown, axis of rotation 6 may be vertical or inclined. Drying chamber 4 has a front access opening 7 closable by a door 8 preferably hinged to casing 2.

Drum 3 may be rotated about axis of rotation 6 by an electric motor, schematically illustrated in FIG. 2 and indicated with reference number 9, and is fed with hot air heated by a heating device 10 and fed into drum 3 preferably by a fan 11. Fan 11 may preferably, though not necessarily, be driven by electric motor 9 or, in an alternative embodiment (not shown), by an auxiliary electric motor (not shown) independent of electric motor 9.

In the FIG. 2 example, one opened side of the drum 3 of the laundry drier 1 is advantageously associated, in a rotatable and substantially air-tight way, to a perforated inner wall 12 fixed to a lateral wall of casing 2 and through which hot air flows into drum 3; the other opened side of the drum 3 is advantageously associated, in a rotatable and substantially air-tight way, to a flange 13 fixed to casing 2 and interposed between door 8 and front access opening 7.

Figure 1:
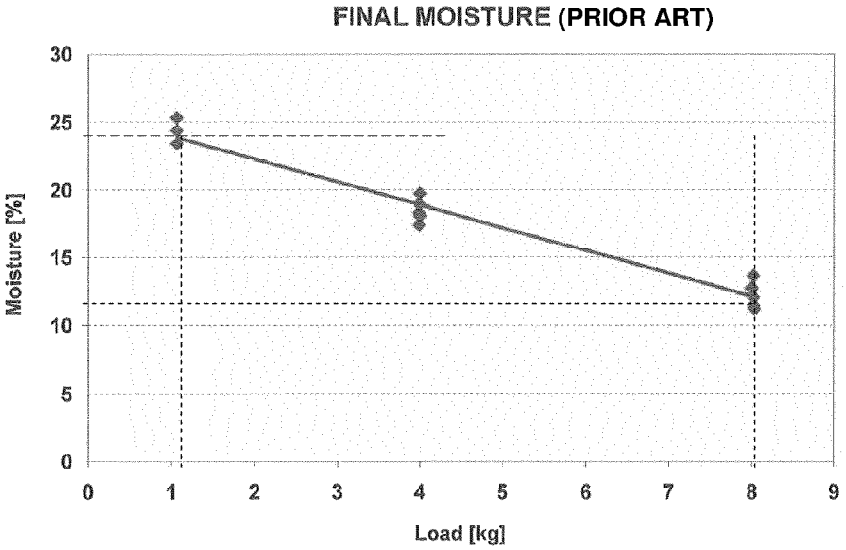
FIG. 1 shows a laundry moisture graph for different quantities/weights of laundry, obtained using a known method of controlling a rotatable-drum laundry drier.
Figure 3:
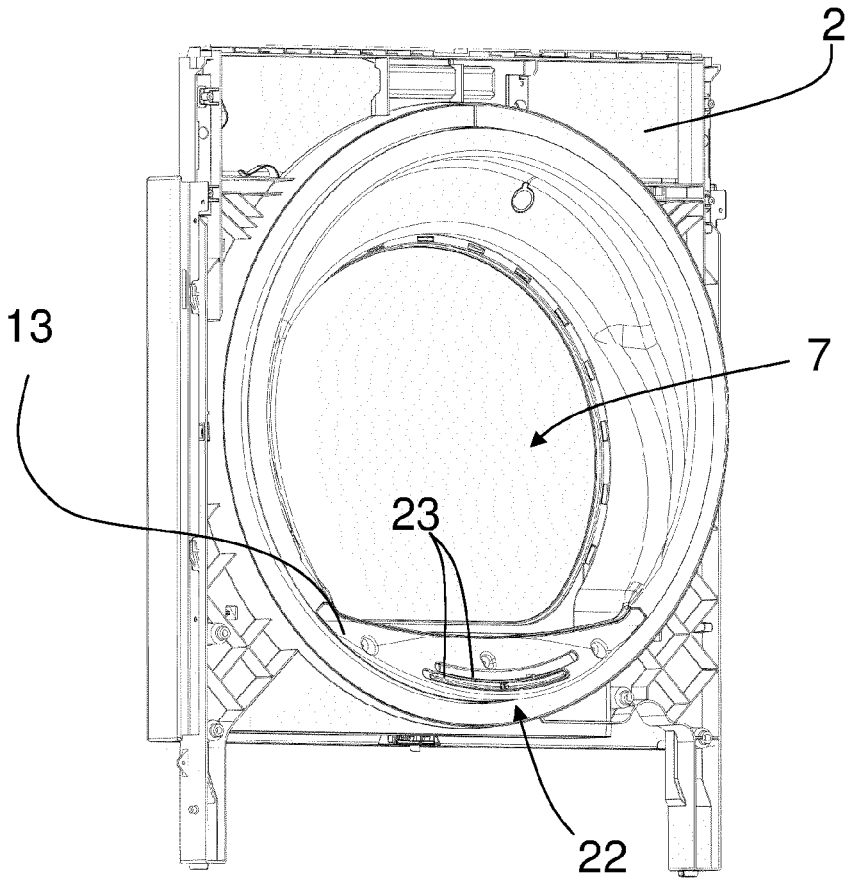
FIG. 3 shows an inner lateral wall of the FIG. 1 rotatable-drum laundry drier, housing moisture measuring sensors/electrodes.

In the FIGS. 2 and 3 example, flange 13 is fixed firmly to casing 2, and is positioned at front opening 7 so as to project at least partly inside drum 3, so that its inner surface faces the laundry 5 when the latter is loaded into the drum 3. Heating device 10 may advantageously comprise one or more electric heating components, such as electric resistors (not shown), or, in an alternative embodiment, a heat pump.

In actual use, fan 11 blows a stream of drying air, produced by heating device 10, into drum 3, preferably through perforated inner wall 12. After contacting laundry 5 inside drum 3, the moisture-laden drying air flows out of drum 3 and it is preferably directed to a condensing device 15, which cools the drying air to condense the moisture inside it. For this purpose, condensing device 15 may be supplied with cold air from outside the drier, and feeds the moisture-free air to fan 11. It should be pointed out that condensing device 15 as described above applies, purely by way of example, to one possible embodiment of the present invention, and may be omitted in the case of an exhaust-type rotatable-drum laundry drier 1 (i.e. in which the hot and moisture-laden drying air from the rotatable laundry drum 3 is expelled directly out of rotatable-drum laundry drier 1).

Rotatable-drum laundry drier 1 also comprises an electronic control unit 14 configured to control rotatable-drum laundry drier 1 (preferably on the basis of a drying cycle selected by user by control interface 18 provided preferably on a control panel 16 of the laundry drier 1), and to implement a laundry drying cycle, for example, a "cotton laundry drying cycle" and/or a "synthetic fabric laundry drying cycle".

Electronic control unit 14 is advantageously configured also to control heating device 10 and/or fan 11 to regulate the temperature and/or flow of hot air into drum 3 according to the selected laundry drying cycle.

Advantageously, electronic control unit 14 is also designed to control electric motor 9, during the drying cycle, to regulate the rotation speed of drum 3 about axis of rotation 6 according to the user-selected drying cycle.

Advantageously, the laundry drier 1 also comprises moisture sensors 22, operatively connected to the electronic control unit 14 for measuring the moisture in laundry 5 during the drying cycle; when a piece of laundry 5 contacts moisture sensors 22, the electronic control unit 14 may therefore measure the moisture of this piece of laundry 5.

In the FIG. 3 example, moisture sensors 22 may advantageously comprise at least one pair of electrodes 23 located preferably, though not necessarily, in flange 13 and positioned facing the inside of drum 3 to generate an electric signal related to an electric quantity Z(ti)—e.g. the resistance and/or conductance and/or impedance between electrodes 23—corresponding to the moisture in laundry 5 when the latter contacts the electrodes 23.

Electronic control unit 14 is advantageously configured to receive the electric signal from moisture sensors 22 to determine electric quantity Z(t) related to the moisture in the laundry 5; and to determine the drying cycle end time $t_{END}$ (i.e. the time at which the drying cycle has to be ended) on the basis of the moisture corresponding to electric quantity Z(t).

Advantageously the rotatable-drum laundry drier 1 comprises a memory device (for example an EPROM, a microprocessor, etc), not illustrated, preferably, but not necessarily, contained in the electronic control unit 14, in which a comparison threshold Fc(t), variable in time according to a predetermined profile, is memorized.

Advantageously, the electronic control unit 14 is configured to:

- measure the electric quantity Z(ti) at predetermined drying times ti in the drying cycle;
- at each of these drying times ti, compare the measured electric quantity Z(ti) with the comparison threshold Fc(ti) corresponding to drying time ti;
- determine the end of drying cycle time $t_{END}$ on the basis of the above comparison.

Electronic control unit 14 is preferably configured to determine the end of drying cycle time $t_{END}$ at the drying time ti at which the measured electric quantity Z(ti) reaches a comparison threshold Fc(ti). In other words, the end of drying cycle time $t_{END}$ may advantageously correspond to the drying time ti at which the measured electric quantity Z(ti) reaches the value of the comparison threshold Fc(ti) corresponding to drying time ti.

The time-variable comparison threshold Fc(t) may advantageously be stored in a comparison table (not shown), contained in the memory device, comprising a number of numeric comparison values, each associated with one, and preferably only one, predetermined drying time ti in the drying cycle.

The numeric comparison values defining comparison threshold Fc(t) are preferably determined experimentally as a function of laundry quantity/weight, and so correspond indirectly to respective laundry quantities/weights.

Comparison threshold Fc(t) may advantageously vary in time according to a predetermined discrete profile, e.g. a step profile, in which each step has a predetermined numeric value indicating an electric quantity Z, and corresponds to a given laundry quantity/weight.

Figure 4:
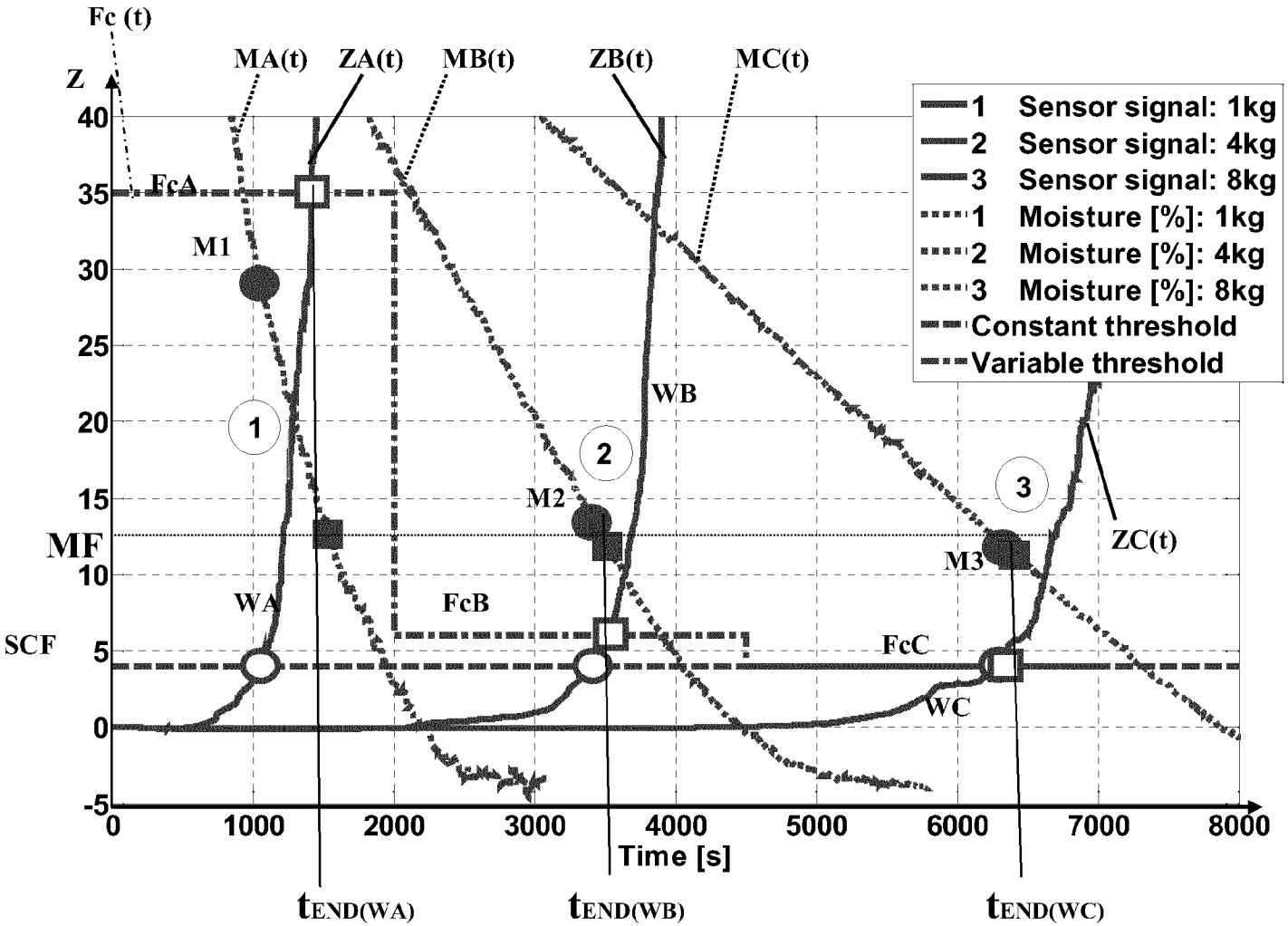
FIG. 4 shows an example of a comparison threshold, variable in time according to a predetermined profile, employed in the control method according to an embodiment of the present invention.

FIG. 4 shows, purely by way of example, a comparison threshold Fc(t) varying in time according to a given discrete profile. More specifically, FIG. 4 shows: the time patterns ZA(t), ZB(t), ZC(t) of electric quantity Z(t) associated with the electric signal generated by electrodes 23 in three different laundry load conditions WA=1 kg, WB=4 kg, WC=8 kg; and the laundry moisture time patterns MA, MB, MC in load conditions WA, WB, WC respectively.

As shown in FIG. 4, unlike the known art, in which comparing electric quantities ZA(t), ZB(t), ZC(t) of loads WA, WB, WC with a time-constant comparison threshold SCF gives different moisture values M1, M2, M3, the method according to embodiments of the present invention, by employing a comparison threshold Fc(t) variable in time according to a predetermined profile, has the advantage of obtaining substantially the same final moisture value MF regardless of the quantity/weight of the laundry.

More specifically, in the FIG. 4 example, comparison threshold Fc(t) comprises three distinct numeric values: FcA corresponding to laundry weight WA; FcB<FcA corresponding to laundry weight WB; and FcC<FcB corresponding to laundry weight WC.

It should be pointed out that the laundry quantity/weight may advantageously be determined indirectly on the basis of the comparison between electric quantity Z(t) and relative comparison threshold Fc(t).

For example, with reference to the FIG. 4, if electric quantity Z(t) is equal to or greater than the first comparison threshold value FcA at the initial drying stage, first quantity/weight WA is determined; if electric quantity Z(t) is equal to or greater than the second value FcB at the intermediate drying stage, second quantity/weight WB is determined; and if electric quantity Z(t) is equal to or greater than the third value FcC at the final drying stage, third quantity/weight WC is determined.

In an alternative embodiment, comparison threshold Fc(t) may vary in time according to a predetermined continuous profile, e.g. roughly corresponding to a substantially hyperbolic function, in which each portion of the function corresponds to a given laundry quantity/weight.

Figure 5:
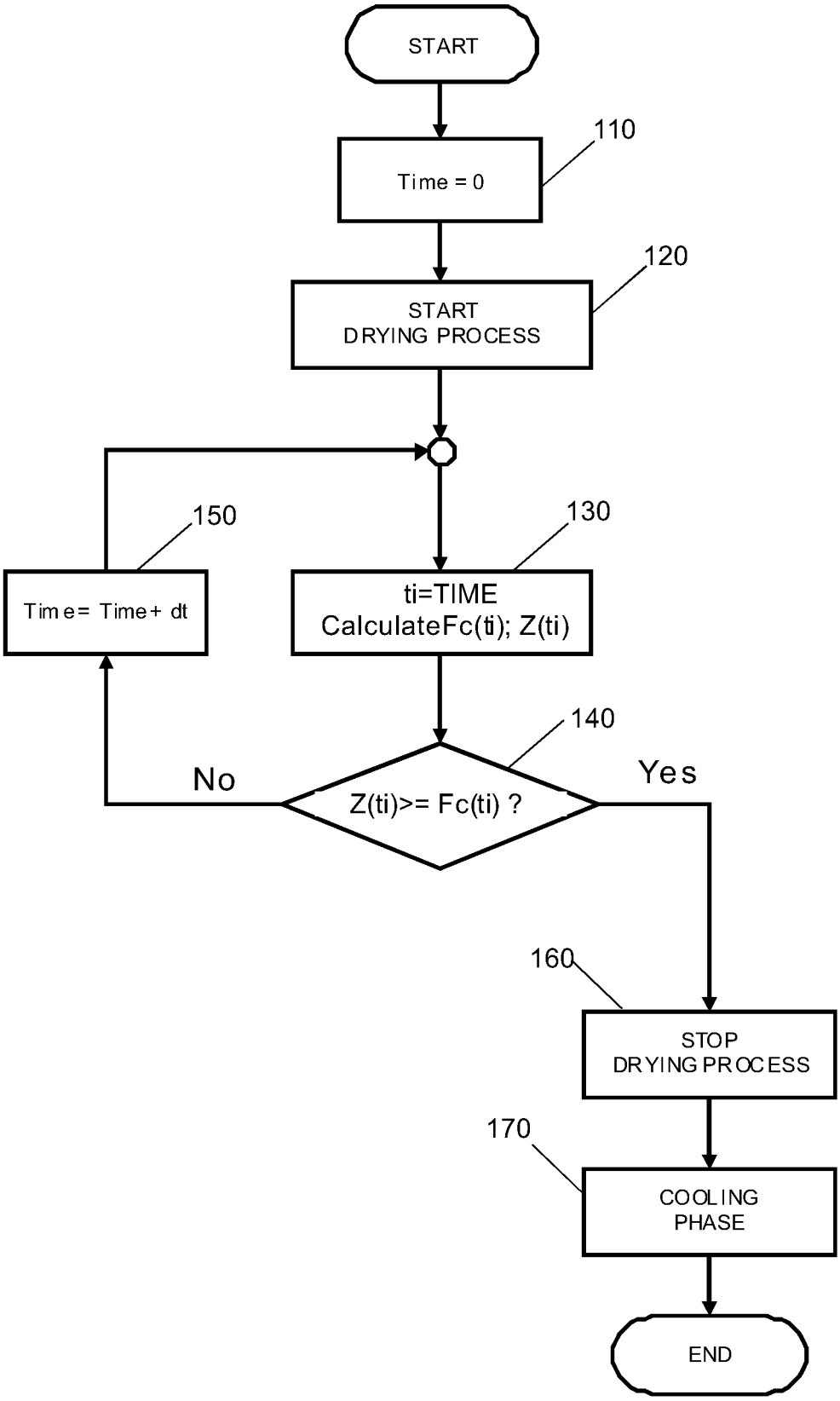
FIG. 5 shows an example of an operation flow chart of the control method implemented by the FIG. 2 rotatable-drum laundry drier.

FIG. 5 shows a flow chart of the operations performed in an example of a control method implemented by electronic control unit 14 to control rotatable-drum laundry drier 1.

At the start of the drying cycle, electronic control unit 14 assigns a zero value to a time control variable, TIME=0 (block 110), and starts the drying cycle (block 120), during which it controls rotation of drum 3, turns on heating device 10, and runs fan 11 to regulate the temperature and/or flow of hot air into drum 3 according to the temperature and flow of the user-selected drying cycle.

At predetermined times ti, electronic control unit 14 determines electric quantity Z(ti), corresponding to the moisture in the laundry, on the basis of the electric signal from electrodes 23, and calculates comparison threshold Fc(ti) (block 130); and compares electric quantity Z(ti) with comparison threshold Fc(ti) (block 140). If electric quantity Z(ti) is below comparison threshold Fc(ti) (NO output of block 140), electronic control unit 14 increases the time variable TIME=TIME+dt by a predetermined value dt (block 150) and repeats the operations in block 130.

Conversely, i.e. if electric quantity Z(ti) is equal to or above comparison threshold Fc(ti) (YES output of block 140), electronic control unit 14 determines the end of drying cycle time $t_{END}$ (block 160) and stops the drying cycle accordingly.

Electronic control unit 14 may preferably stop the drying cycle (block 160) and advantageously start an optional laundry cooling stage (block 170).

Stopping the drying cycle (block 160) may preferably comprise turning off heating device 10.

The purpose of the cooling stage is to lower the high temperature (e.g. 70° C.) of the laundry to a predetermined low temperature (e.g. 50° C.) at which laundry 5 can be handled by the user.

At the cooling stage, drum 3 may be kept turning, and non-heated air fed into drum 3. And electronic control unit 14 may advantageously be designed to: calculate the quantity/weight of laundry 5 on the basis of comparison threshold Fc(ti) at end of drying cycle time $t_{END}$; and adjust the length of the cooling stage accordingly. For this purpose, electronic control unit 14 may comprise test data stored in a table, and by which to determine the length of the cooling stage for each quantity/weight of laundry 5.

The control method described above may be coded to advantage in software loadable onto electronic control unit 14 of rotatable-drum laundry drier 1, and designed, when executed, to configure electronic control unit 14 to control rotatable-drum laundry drier in accordance with the method.

Besides being implementable in a rotatable-drum laundry drier 1 with no need for weight sensors or similar, and without increasing the complexity and, therefore, cost of the drier, the method described has the major advantage of obtaining a precise, stable final moisture of the laundry, i.e. corresponding to a predetermined fixed value, regardless of the laundry quantity/weight.

By permitting indirect calculation of the laundry quantity/weight, the method described also has the advantage of enabling suitable adjustment of the laundry cooling stage.

Clearly, changes may be made to the method and to the rotatable-drum laundry as described and illustrated herein without, however, departing from the scope of the present invention.

The invention claimed is:

1. A control method for controlling a rotatable-drum laundry drier to dry laundry in a drum, said control method comprising the steps of:

memorizing, in a memory device of said laundry drier, a comparison threshold which is variable in time according to a predetermined profile, starting a laundry drying cycle, and at predetermined drying times) in the laundry drying cycle:

measuring an electric quantity indicating the moisture in the laundry at the drying time;

comparing, at each drying time, the measured electric quantity with the memorized comparison threshold corresponding to the drying time;

determining the end of drying cycle time on the basis of said comparison; and terminating the drying cycle based on the determined end of drying cycle time.

2. A control method as claimed in claim 1, wherein the end of drying cycle time corresponds to the drying time at which said measured electric quantity reaches said comparison threshold.

3. A control method as claimed in claim 1, wherein said comparison threshold is variable in time according to a predetermined discrete profile.

4. A control method as claimed in claim 3, wherein said predetermined discrete profile comprises a number of different threshold values, each corresponding to a predetermined drying time interval and to a predetermined laundry quantity/weight.

5. A control method as claimed in claim 1, wherein the comparison threshold is variable in time according to a predetermined continuous profile.

6. A control method as claimed in claim 1, wherein said electric quantity is the resistance/conductance/impedance measured between at least two measuring electrodes positioned in such a way to contact the laundry in the drum.

7. A control method as claimed in claim 1, further comprising the steps of:

calculating the laundry quantity/weight on the basis of the comparison threshold corresponding to the end of drying cycle time; and adjusting the duration of a laundry cooling stage, subsequent to the end of drying cycle time, on the basis of the calculated laundry quantity/weight.

8. A rotatable-drum laundry drier comprising:

a rotatable drum defining a drying chamber for laundry;

a heating device for feeding hot air to the drum to dry laundry therein;

a memory device in which a comparison threshold, which is variable in time according to a predetermined profile, is memorized; and an electronic control unit configured to:

start a laundry drying cycle;

measure an electric quantity indicating the moisture in the laundry in the drum at a drying time;

compare said measured electric quantity with the comparison threshold corresponding to said drying time;

determine the end of drying cycle time on the basis of said comparison; and terminate the drying cycle based on the determined end of drying cycle time.

9. A rotatable-drum laundry drier as claimed in claim 8, wherein the end of drying cycle time corresponds to the drying time at which said measured electric quantity reaches said comparison threshold.

10. A rotatable-drum laundry drier as claimed in claim 8, wherein said comparison threshold is variable in time according to a predetermined discrete profile.

11. A rotatable-drum laundry drier as claimed in claim 8, wherein said predetermined discrete profile comprises a number of different threshold values, each corresponding to a predetermined drying time interval and to a laundry quantity/weight.

12. A rotatable-drum laundry drier as claimed in claim 8, wherein said comparison threshold is variable in time according to a predetermined continuous profile.

13. A rotatable-drum laundry drier as claimed in claim 8, wherein said electric quantity is the resistance/conductance/impedance measured between two electrodes contacting the laundry.

14. A rotatable-drum laundry drier as claimed in claim 8, wherein said electronic control unit is configured to calculate the laundry quantity/weight on the basis of the comparison threshold corresponding to the end of drying cycle time, and to adjust the duration of a laundry cooling stage, subsequent to the end of drying cycle time, on the basis of the calculated laundry quantity/weight.

15. An electronic control unit for controlling a rotatable-drum laundry drier, and configured to implement a control method as claimed in claim 1.

16. A control method as claimed in claim 2, wherein said comparison threshold is variable in time according to a predetermined discrete profile.

17. A control method as claimed in claim 16, wherein said predetermined discrete profile comprises a number of different threshold values, each corresponding to a predetermined drying time interval and to a predetermined laundry quantity/weight.

18. A control method as claimed in claim 2, wherein the comparison threshold is variable in time according to a predetermined continuous profile.

19. A control method as claimed in claim 2, wherein said electric quantity is the resistance/conductance/impedance measured between at least two measuring electrodes positioned in such a way to contact the laundry in the drum.

20. A control method as claimed in claim 3, wherein said electric quantity is the resistance/conductance/impedance measured between at least two measuring electrodes positioned in such a way to contact the laundry in the drum.

* * * * *